US010966545B2

(12) United States Patent
Mastrosimone-Gese et al.

(10) Patent No.: US 10,966,545 B2
(45) Date of Patent: Apr. 6, 2021

(54) TRANSFORMABLE BABY ACTIVITY CENTER WITH ARCH

(71) Applicant: Mattel, Inc., El Segundo, CA (US)

(72) Inventors: Mary G. Mastrosimone-Gese, East Aurora, NY (US); Rachel Elizabeth Ruth-Klos, Attica, NY (US); Kevin Gastle, Boston, NY (US); Benjamin M. Cerny, Snyder, NY (US)

(73) Assignee: Mattel, Inc., El Segundo, CA (US)

( * ) Notice: Subject to any disclaimer, the term of this patent is extended or adjusted under 35 U.S.C. 154(b) by 348 days.

(21) Appl. No.: 16/039,428

(22) Filed: Jul. 19, 2018

(65) Prior Publication Data

US 2020/0022506 A1 Jan. 23, 2020

(51) Int. Cl.
*A47D 15/00* (2006.01)

(52) U.S. Cl.
CPC ..... *A47D 15/003* (2013.01); *A47D 15/008* (2013.01)

(58) Field of Classification Search
CPC ... A47D 15/003; A47D 15/008; A63H 33/006
See application file for complete search history.

(56) References Cited

U.S. PATENT DOCUMENTS

| | | | | |
|---|---|---|---|---|
| 7,117,552 | B2 | 10/2006 | Hoffman | |
| 8,667,626 | B2 * | 3/2014 | Zheng | A63H 33/006 5/99.1 |
| 2004/0242118 | A1 * | 12/2004 | Schreiber-Setzemski | A47D 15/003 446/227 |
| 2006/0199166 | A1 | 9/2006 | Snyder et al. | |
| 2009/0017718 | A1 | 1/2009 | Bryan et al. | |
| 2009/0205140 | A1 * | 8/2009 | Reese | A47D 13/066 5/714 |
| 2019/0022541 | A1 * | 1/2019 | Reese | A63H 33/006 |

* cited by examiner

*Primary Examiner* — Eric J Kurilla
*Assistant Examiner* — James T Coble
(74) *Attorney, Agent, or Firm* — Edell, Shapiro & Finnan, LLC

(57) ABSTRACT

A baby activity center comprising a foldable mat and a pair of bendable wings connected to the foldable mat. Each bendable wing has an opening. An arch is further coupled to the foldable mat and is positionable in an upright position and a recumbent position. While in the upright position, the arch is engaged with the openings in the pair of bendable wings. While in the recumbent position, the arch is disengaged from the openings in the pair of bendable wings. The baby activity center transforms to a gym configuration where the foldable mat is expanded and the arch is positioned in the upright position across the foldable mat. The baby activity center further transforms to a transport configuration where the foldable mat is folded and the arch is positioned in the recumbent position between the folded mat.

20 Claims, 5 Drawing Sheets

TRANSFORMABLE BABY ACTIVITY CENTER WITH ARCH

FIELD OF THE INVENTION

The present invention relates generally to baby toys and accessories, and in particular, baby activity centers.

BACKGROUND OF THE INVENTION

Baby activity centers such as play mats and gyms provide a safe, comfortable, and sanitary environment for a baby to play on. Available in different shapes, sizes, and configurations, baby play mats and gyms typically provide a padded area large enough for a baby to lie and possibly roll on. Various toys and sensory-stimulating accessories may be further placed overhead via an arch or canopy to provide stimulation and entertainment to the baby. Baby play mats and gyms help promote physical, sensory, and cognitive development in a baby, for example, by encouraging the use of different motor skills (e.g., grasping, reaching, hand-eye coordination, etc.).

However, due to the size of conventional play mats and gyms, it is often cumbersome and inconvenient for parents to bring along a play mat or gym while traveling. This is even more apparent with play gyms that have a canopy or overhead arches. Such play mats and gyms also take up valuable floor area in homes with limited space. Thus, there is a need for a baby activity center that can be easily transported and stored when not in use. There is a further need for a baby activity center that transforms into different configurations to provide multiple modes of use.

SUMMARY OF THE INVENTION

The present invention provides a baby activity center that can be easily folded for storage and travel. The baby activity center provides a foldable mat for a baby to lie on and an overhead arch with toys and accessories attached that the baby can play and interact with. By folding the mat and repositioning the arch between the folded mat, the baby activity center transforms into a more compact storage/transport configuration.

According to one aspect of the present invention, a baby activity center is provided. The baby activity center comprises a foldable mat that has a first edge and a second edge. A first bendable wing and a second bendable wing are respectively connected to the first edge and the second edge of the foldable mat. The baby activity center also includes an arch having a first end and a second end that are coupled to the foldable mat. The arch bridges the first and second edges of the foldable mat and is positionable in an upright position where the arch is substantially perpendicular to the foldable mat and a recumbent position where the arch is substantially parallel to the foldable mat.

The baby activity center is transformable into different configurations. In the gym configuration, the foldable mat is expanded and the arch is in the upright position. In the activity mat configuration, the foldable mat is expanded and the arch is in the recumbent position. In the transport configuration, the foldable mat is folded and the arch is positioned between the folded mat in the recumbent position. The foldable mat further has a first end and a second end. In one or more embodiments, the first end includes a loop and the second end includes a slit for the loop to pass through while the foldable mat is folded in the transport configuration. In one instance, the foldable mat is an obround or oval shape.

The first bendable wing has a first opening and the second bendable wing has a second opening. Preferably, the first and second openings are oval shaped. While the arch is in the upright position, the first and second ends of the arch are respectively engaged with the first and second openings. The arch is maintained in the upright position by the engagement of the first and second ends of the arch with the first and second bendable wings and the positioning of the first and second ends of the arch on a support surface. In certain embodiments, the first and second bendable wings are removably attached to the arch while the arch is in the upright position. While the arch is in the recumbent position, the first and second ends are respectively disengaged from the first and second openings.

The baby activity center further comprises a first coupling member and a second coupling member. The first and second coupling members respectively couple the first and second ends of the arch to the foldable mat. Thus, the arch is still attached to the foldable mat while in the recumbent position. This keeps the arch from getting lost and makes it easier to position the arch on the foldable mat. In one embodiment, the foldable mat has an upper surface and a bottom surface and the first and second coupling members are each secured with at least two reinforcement points to the bottom surface of the mat. Preferably, one of the reinforcement points for each of the first and second coupling members is respectively along the first and second edge of the foldable mat.

In one embodiment, the arch has a uniform thickness. In another embodiment, a top portion of the arch is thicker than the rest of the arch. In certain instances, accessories are removably attached to the arch. In other embodiments, the arch has a first side and a second side that is different from the first side. The arch is positionable in the recumbent position with the first side facing the upper surface of the foldable mat or the second side facing the upper surface of the foldable mat.

According to another aspect of the present invention, the baby activity center comprises a foldable mat and a pair of bendable wings connected to the foldable mat. Each bendable wing has an opening. An arch is further coupled to the foldable mat and is positionable in an upright position and a recumbent position. While in the upright position, the arch is engaged with the openings in the pair of bendable wings. The arch is maintained in the upright position by its engagement with the pair of bendable wings and its positioning on a support surface. While in the recumbent position, the arch is disengaged from the openings in the pair of bendable wings.

According to yet another aspect of the present invention, the baby activity center comprises a foldable mat and a pair of bendable wings connected to the foldable mat. Each bendable wing has an opening. An arch is further coupled to the foldable mat and is positionable in an upright position by engaging with the openings in the pair of bendable wings. The arch is also positionable in a recumbent position by disengaging from the openings in the pair of bendable wings. In one or more embodiments, the baby activity center further comprises a pair of coupling members that couple the arch to the foldable mat through the openings in the pair of bendable wings. The baby activity center transforms to a gym configuration where the foldable mat is expanded and the arch is positioned in the upright position across the foldable mat. The baby activity center further transforms to a transport configuration where the foldable mat is folded and the arch is positioned in the recumbent position between the folded mat.

Other objects, features and advantages of the present invention will become apparent to those skilled in the art from the following detailed description. It is to be understood, however, that the detailed description and specific examples, while indicating some embodiments of the invention, are given by way of illustration and not limitation. Many changes and modifications within the scope of the invention may be made without departing from the spirit thereof, and the present invention includes all such modifications.

BRIEF DESCRIPTION OF THE DRAWINGS

Referring now to the drawings in which like reference numbers represent corresponding parts throughout:

FIG. 1A provides a perspective view of the baby activity center from one end and FIG. 1B provides a perspective view of the baby activity center from the other end;

FIG. 4A provides a top view of the baby activity center with one side of the arch facing the foldable mat and FIG. 1B provides a top view of the baby activity center with the other side of the arch facing the foldable mat;

DETAILED DESCRIPTION OF THE INVENTION

The baby activity center according to the present invention provides a comfortable and convenient environment for a baby (e.g., newborn, infant) to play in. In a general embodiment, the baby activity center provides a foldable mat and an overhead arch with attached toys and/or accessories. The foldable mat includes a pair of bendable wings that engage with and help stabilize the overhead arch in an upright position. When disengaged from the bendable wings, the overhead arch is repositionable to a recumbent position and functions as a support for tummy time or part of a sitting play area on the foldable mat. The foldable mat may be further folded over the arch such that the baby activity center transforms into a more compact configuration suitable for transport or storage.

Figure 1A:
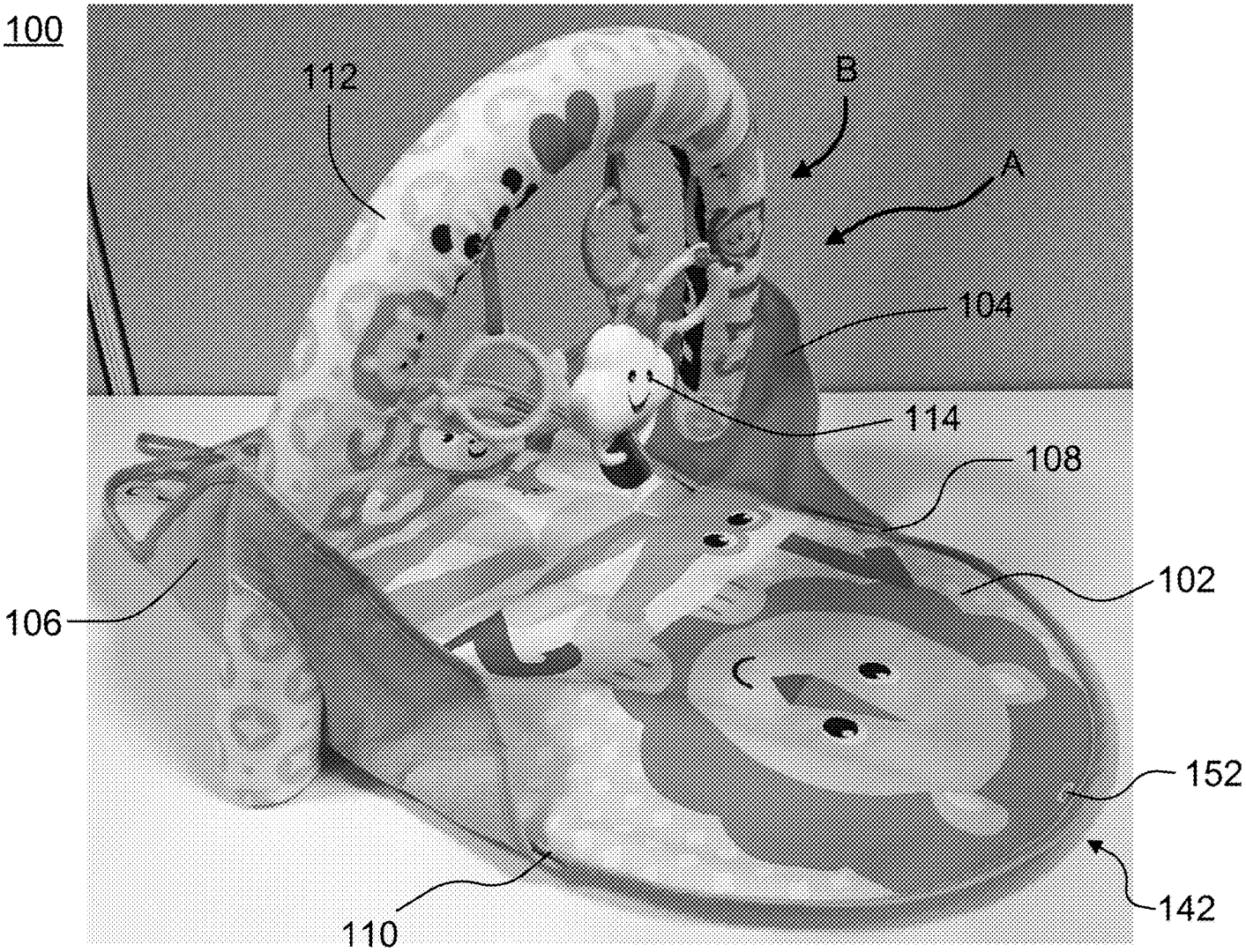
FIGS. 1A-B illustrate various views of a baby activity center in a gym configuration, in accordance with an embodiment of the invention.
Figure 1B:
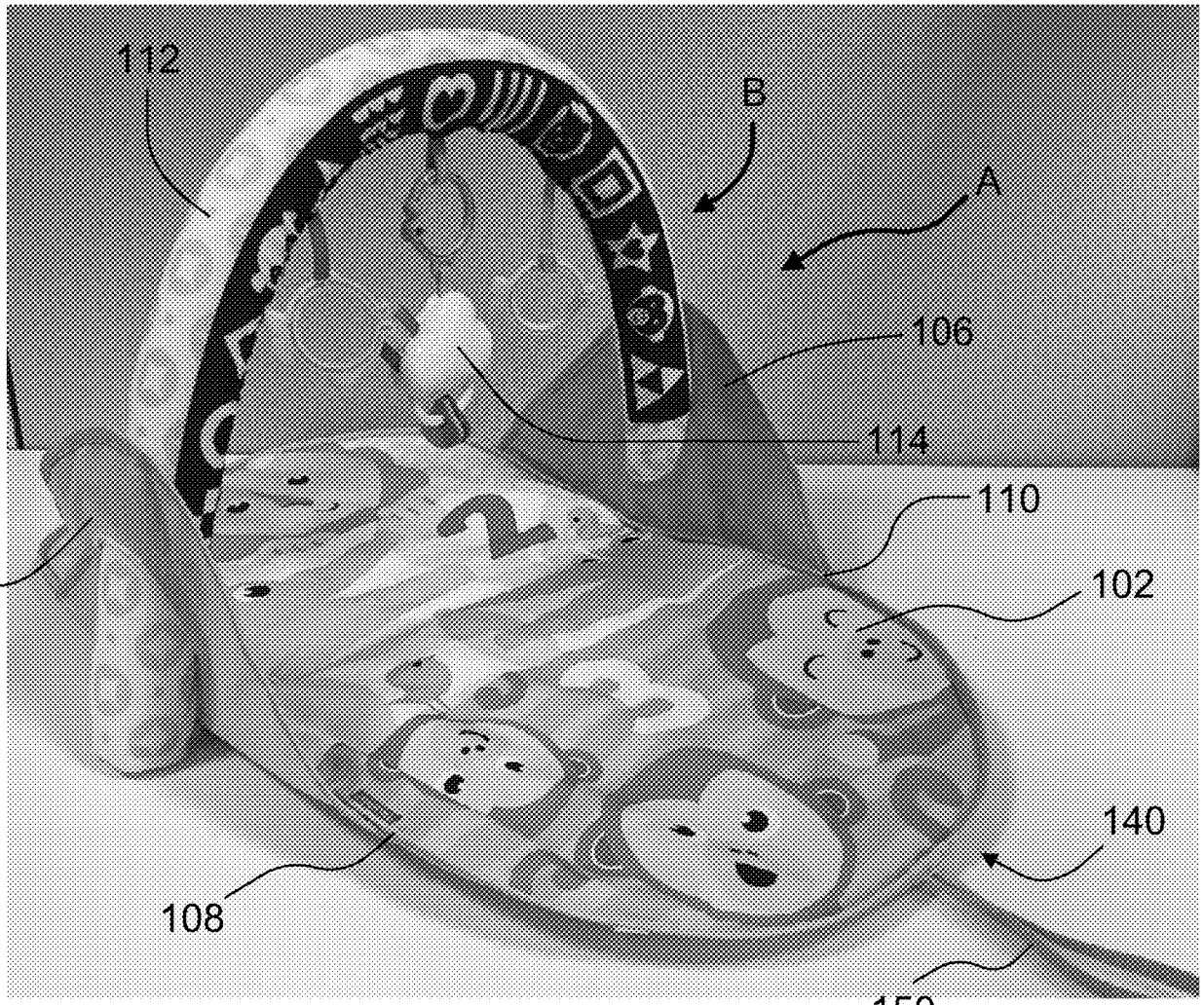

Referring now to FIGS. 1A and 1B, a baby activity center in accordance with an illustrative embodiment of the invention is shown. Baby activity center 100 is shown in a gym configuration A, which provides a play area for a supine newborn baby. The baby activity center 100 has foldable mat 102 that is expanded to provide a padded area to place the baby. The mat 102 is manufactured from fabric or a similar material between which batting or other filling material is accommodated. Preferably, the fabric used for the mat 102 is a soft, washable material that will not irritate the baby's skin. Though the mat 102 is shown as being substantially obround or oval (see, e.g., FIGS. 4A and 4B), embodiments of the baby activity center also include foldable mats of different sizes and/or shapes (e.g., rectangular, circular, etc.).

Two wings 104, 106 are attached to the mat 102 along the edges 108, 110, respectively. The two wings 104, 106 are triangularly shaped (see, e.g., FIGS. 4A and 4B), though embodiments of the baby activity center also include wings having other shapes (e.g., rectangular, semi-circular, etc.). The two wings 104, 106 are also made from fabric or a similar material, which allows them to be soft and flexible enough to be bent into various configurations and positions. In the gym configuration A shown in FIGS. 1A and 1B, the two wings 104, 106 are bent upwards/inwards from the mat 102.

The baby activity center 100 also includes an arch 112 that bridges the edges 108, 110 of the mat 102. Preferably, the arch 112 is flexible and elastic, but also firm enough to maintain an upright arcuate shape while the baby activity center 100 is in the gym configuration A. While in an upright position B, the arch 112 engages with and passes through the wings 104, 106. The ends of the arch 112 further contact a support surface or floor. The diameter/thickness of the ends affects the stability of the arch 112 in the upright position (for example, a larger diameter provides greater stability). The arch 112 is thus supported in the upright position B by the wings 104, 106 and the thickness/dimensions of the arch 112 itself, without requiring an additional base or supporting member. Eliminating the need for a cumbersome support or base to hold the arch 112 in the upright position B provides numerous benefits, including reduction of manufacturing costs, reduction of the overall weight of the activity center 100, increased portability of the activity center 100, and easier repositioning of the arch 112 onto the foldable mat 102.

In one embodiment, the arch 112 is manufactured from polyethylene (PE) foam. The arch 112 may also be manufactured from other materials, such as rubber, silicone, plastic, or other polymers and may comprise a hollow core for reduced weight. In an illustrative embodiment, the arch 112 is exuded as an elongate cylindrical member during the manufacturing process and then bent to form an arch-like structure. The arch 112 is further covered with a cloth shell or soft fabric material. Additional padding surrounding the arch 112 may also be included.

Toys and accessories 114 are attached to the arch 112. In the illustrative embodiment shown in FIGS. 1A and 1B, two rings and a cloud-shaped toy are attached to the arch 112. Other toys and accessories 114 such as rattles, mirrors, rings, teethers, and squeakers may also be attached to the arch 112. In some embodiments, the toys and accessories 114 are detachable from the arch 112.

While the baby activity center 100 is in the gym configuration A, the arch 112 is in an upright position B where the arch 112 is substantially perpendicular to the mat 102. The arch 112 is positioned such that a baby lying on the mat 102 can look at and play with the toys and accessories 114 attached to the arch 112. The arch 112 is high enough so that the toys and accessories 114 do not directly contact the baby lying underneath, but also low enough that the baby is able to reach and interact with the toys and accessories 114. In the illustrative embodiment shown in FIGS. 1A and 1B, the arch 112 is positioned approximately in the middle of the mat 102, though in other embodiments, the arch 112 may be positioned closer towards either end of the mat 102.

Figure 2:
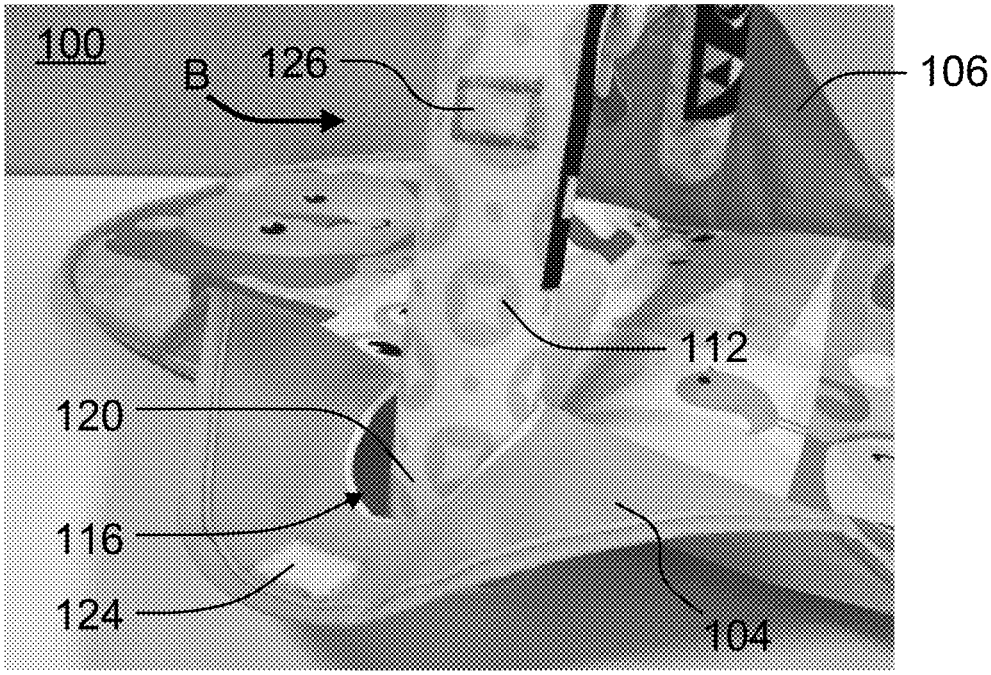
FIG. 2 illustrates a close-up of an arch engaged with a bendable wing of the baby activity center of FIGS. 1A-B, in accordance with an embodiment of the invention.

FIG. 2 shows a close-up of the arch 112 engaged with the wing 104 of the baby activity center 100. In describing the engagement of the arch 112 with the wing 104, it is to be noted that the arch 112 is also similarly engaged with the other wing 106. Referring back to the figure, the wing 104 has an opening 116 that an end portion 120 of the arch 112 is placed through. In a preferred embodiment, the opening 116 is oval shaped (see also FIGS. 4A and 4B). By engaging the end portion 120 with the opening 116, the wing 104 helps maintain the arch 112 in the upright position B.

Additionally, wing 104 is removably attached to the arch 112 using complementary hook-and-loop fasteners 124, 126 (e.g., Velcro™) to secure the engagement between the wing 104 and arch 112. The wing 104 may also be attached to the arch 112 using other methods such as buttons, snap fasteners, and magnets. While attached to arch 112, wing 104 is bent upwards in a position substantially perpendicular to the mat 102 (see, e.g., FIGS. 1A and 1B). Securing the wing 104 to the arch 112 helps prevent the arch 112 from accidentally disengaging from the wing 104. Arch 112 can also act as a handle for lifting and moving the baby activity center 100.

Figure 3:
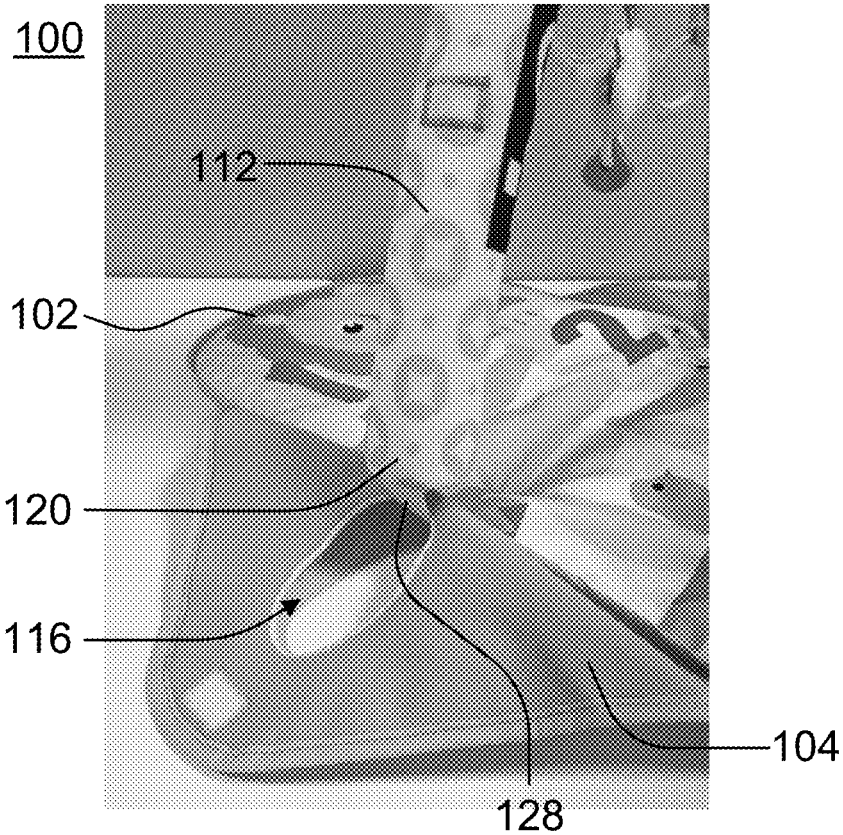
FIG. 3 illustrates a close-up of the arch disengaged from the bendable wing of the baby activity center of FIGS. 1A-B, in accordance with an embodiment of the invention.

FIG. 3 shows a close-up of the arch 112 disengaged from the wing 104 of the baby activity center 100. Here, the end portion 120 of the arch 112 is removed from the opening 116 in the wing 104. This allows the wing 104 to be bent downwards to a position substantially coplanar with the mat 102. While disengaged from the wing 104, arch 112 can be repositioned, for example, to a recumbent position substantially parallel to the mat 102. A coupling member 128 further couples the arch 112 to the bottom or underside of the mat 102 (see, e.g., FIG. 5).

Figure 4A:
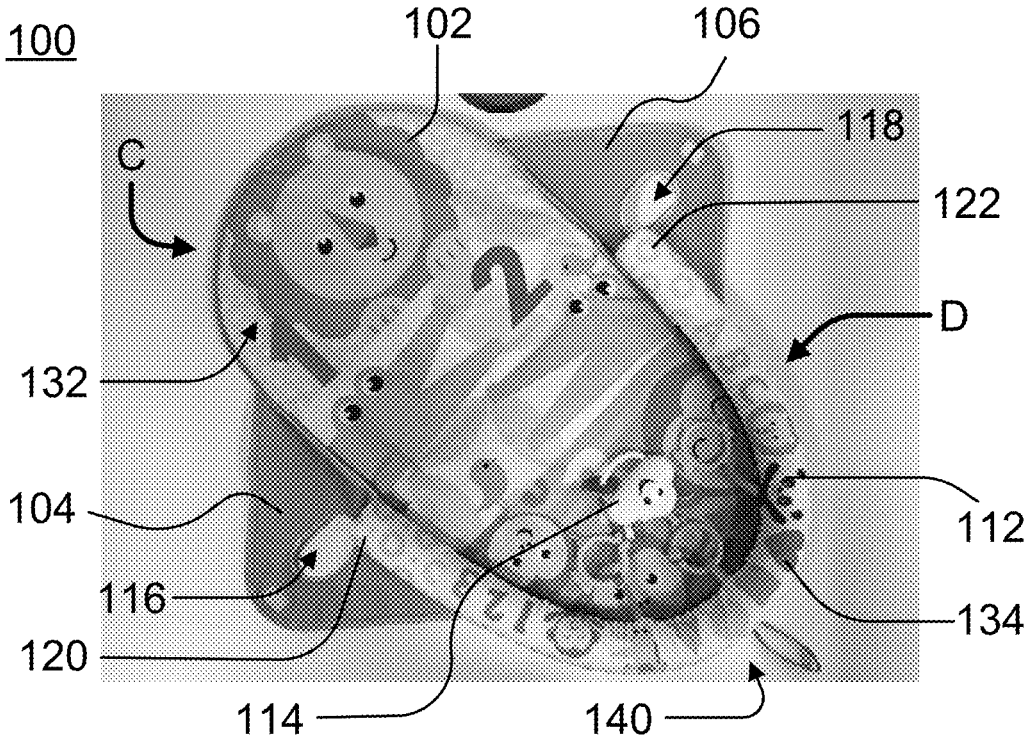
FIGS. 4A-B illustrate various views of the baby activity center in an activity mat configuration, in accordance with a further embodiment of the invention.
Figure 4B:
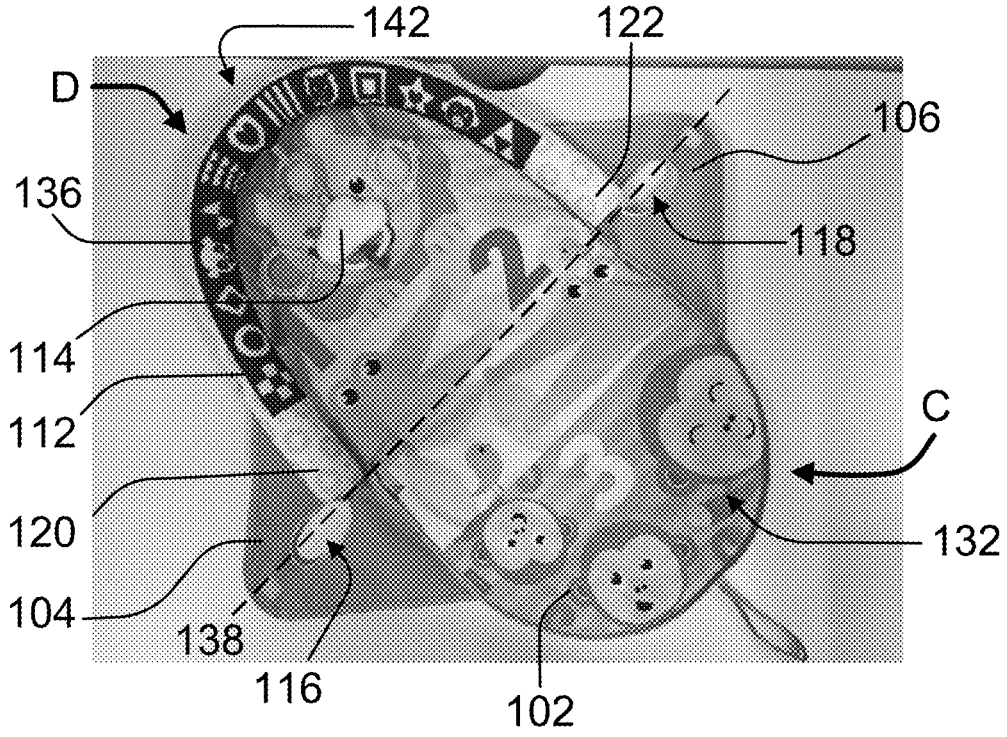

FIGS. 4A-B show the baby activity center 100 in an activity mat configuration C. This configuration provides further modes of use, such as an environment for tummy time and/or sitting play, for additional benefits and value. In this configuration, the arch 112 is disengaged from the wings 104, 106 and positioned in a recumbent position D on the upper surface 132 of the mat 102. The arch 112 has two sides 134, 136 and can be positioned with either side facing upwards and away from the upper surface 132 of the mat 102. In certain embodiments, the two sides 134, 136 of the arch 112 display different images or decorations. For example, as shown in FIGS. 4A and 4B, the first side 134 of the arch 112 has a first set of decorations and the second side 136 of the arch 112 has a second set of decorations that differ from the first set of decorations. For example, the first set of decorations of the first side 134 may be colored decorations while the second set of decorations of the second side 136 may be black-and-white decorations.

Coupling members 128, 130 (see FIG. 5) connect the ends 120, 122 of the arch 112 to the mat 102 (see FIGS. 4A and 4B). The arch 112 therefore remains coupled to the mat 102 even when it is disengaged from the wings 104, 106. This is useful, for example, in preventing the arch 112 from becoming lost or separated from the baby activity center 100 when transporting or storing the baby activity center 100. Additionally, the coupling members 128, 130 prevent the arch 112 from being displaced while it is used as a pillow or support. The coupling members 128, 130 further restrict the arch 112 to pivot generally along an axis 138. This limits the placement of the arch 112 to designated areas and orientations on the mat 102 (e.g., the positions shown in FIGS. 1A, 4A, and 4B). In one instance, the arch 112 is positioned such that the curvature of the arch 112 matches the curvature of the ends 140, 142 of the mat 102.

In one or more embodiments, the arch 112 functions as a toy bar or cushion while in the recumbent position D. In some instances, the arch 112 is a pillow or cushion that can be used while a baby is placed in a prone position on the mat 102 for exercise and play (i.e., tummy time). Briefly, tummy time is an activity period where a baby (such as a newborn) is placed in a belly-down position while awake and supervised. Placing the baby in a prone position allows the baby to practice lifting her head against gravity and bearing weight with her arms. These activities help strengthen the muscles of the neck, shoulders, arms, and stomach, which are crucial for developing gross motor skills (e.g., sitting, rolling, pushing up, crawling). A baby can use the arch 112 as a support while pushing up or the arch 112 can be placed under the chest of the baby for extra padding during tummy time.

Additionally, a baby can move and roll from side-to-side while in a prone position on the mat 102. These actions are beneficial in developing coordination, balance and postural control. While in the recumbent position D, the arch 112 may be further used as a safety barrier that prevents the baby from rolling off the mat 102. In some embodiments, the toys and accessories 114 can be detached from the arch 112 when it is in the recumbent position D. The detached toys and accessories 114 may be placed close to the baby during tummy time to encourage her to lift and turn her head, reach, and grasp the toys and accessories 114.

In other instances, the arch 112 is a pillow or cushion that can be used while a baby is placed in a supine position on the mat 102. In one embodiment, the arch 112 is a cradle or head pillow for the baby. In other embodiments, the arch 112 is a seat pillow used to stabilize and support a baby that is sitting upright.

In different embodiments, the thickness and shape of the arch 112 is varied depending on its function while in the recumbent position D (e.g., padding, safety barrier, head pillow, seat pillow). In the illustrative embodiment shown in FIGS. 4A and 4B, the arch 112 is an arcuate cylinder with a uniform thickness. In other embodiments, the arch is formed from a different shape, such as a rectangular prism, triangular prism, or polygonal prism. In yet further embodiments, the top portion or apex of the arch 112 is thicker than the rest of the arch 112 to provide additional padding when used as a pillow.

Figure 5:
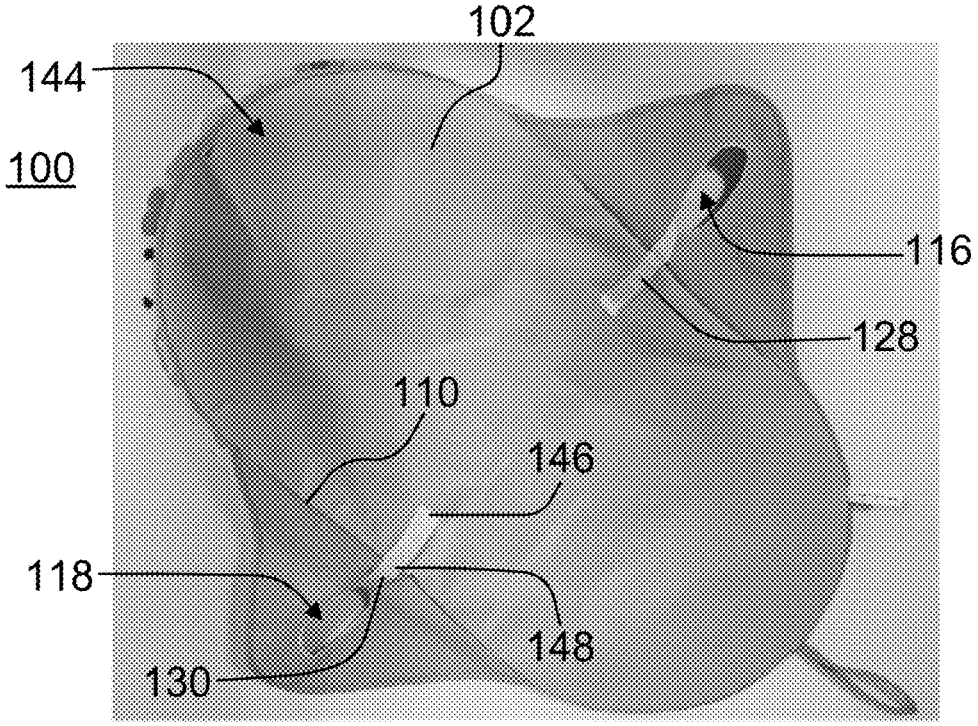
FIG. 5 illustrates a bottom view of the baby activity center in the activity mat configuration, in accordance with an embodiment of the invention.

FIG. 5 shows the bottom of the baby activity center 100. Two coupling members 128, 130 are attached to the bottom surface 144 of the mat 102 and pass through the openings 116, 118. Though the openings 116, 118 are shown as oval shaped, embodiments of the invention include openings having other shapes and sizes. In one or more embodiments, each coupling member 128, 130 is secured with at least two attachment points to the bottom surface 144 of the mat. Preferably, one of the at least two attachment points is positioned along the edge of the mat. For example, as shown in FIG. 5, coupling member 130 is secured to the mat 102 with two attachment points 146, 148 (see also FIG. 6). Attachment point 148 is located near the edge 110 of the mat 102. Having two attachment points 146, 148 helps prevent the edge 110 of the mat 102 from being pulled upwards. In certain embodiments, the coupling members 128, 130 are permanently attached to the mat 102. In other embodiments, the coupling members 128, 130 are removably attached to the mat 102 and/or arch 112, for example using hook-and-loop fasteners.

The bottom surface 144 of the mat 102 is made of a different fabric/material than the upper surface 132. Since the bottom surface 144 of the mat 102 primarily contacts the floor instead of a baby, the bottom surface 144 comprises a more durable fabric than the soft fabric used in the upper surface 132. In some embodiments, the bottom surface 144 comprises a water-proof/resistant material. Additionally, the bottom surface 144 is embossed with non-slip bumps so that the activity center 100 does not move or shift while in contact with the floor.

Figure 6:
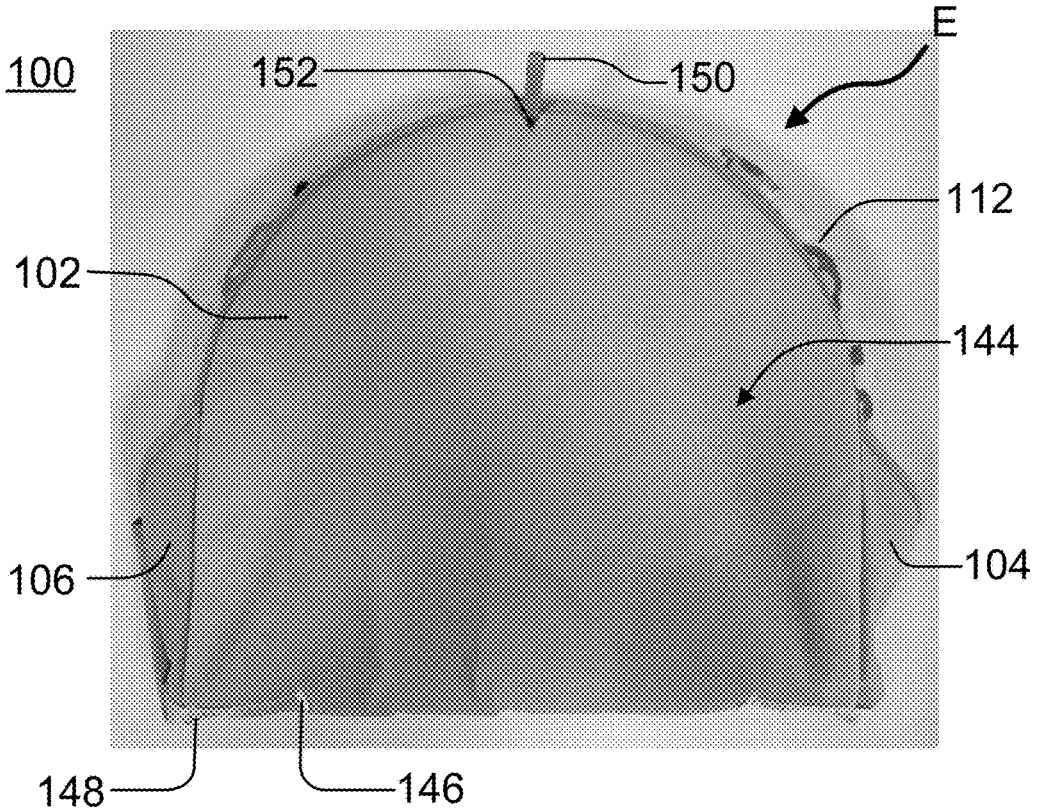
FIG. 6 illustrates a top view of the baby activity center in a transport configuration, in accordance with an embodiment of the invention.

FIG. 6 shows the baby activity center 100 in a transport configuration E. In this configuration, the mat 102 is folded in half along axis 138 (see FIG. 4B) and the arch 112 is sandwiched between the mat 102. This allows the activity center 100 to be in a more compact form for transport and storage. By facing outwards, the bottom surface 144 also helps keep the upper surface 132 of the mat 102 clean. Typically, the arch 112 is disengaged from the wings 104, 106 while the activity center 100 is in the transport configuration E. In other embodiments, the activity center 100 can be transformed to the transport configuration E while the arch 112 is still engaged with the wings 104, 106.

The mat 102 also includes a loop 150 on one end 140 and a slit 152 on the opposite end 142 (see, e.g., FIGS. 1A and 1B). While the mat 102 is folded to the transport configuration E, the slit 152 is positioned such that the loop 150 can pass through. This allows the baby activity center 100 to remain closed while in the transport configuration E and also provides a handle for carrying the activity center 100 (see FIG. 6). Other methods of keeping the mat 102 folded together while in the transport configuration E include complementary hook-and-loop fasteners (e.g., Velcro™), buttons, snap fasteners, and magnets.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims.

Moreover, it is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, the term "exemplary" may be used herein to describe an example or illustration. Any embodiment described herein as exemplary is not to be construed as a preferred or advantageous embodiment, but rather as one example or illustration of a possible embodiment of the invention.

Finally, various features from one of the embodiments may be incorporated into another of the embodiments. Accordingly, it is appropriate that the appended claims be construed broadly and in a manner consistent with the scope of the disclosure as set forth in the following claims.

The invention claimed is:

1. A baby activity center comprising:

a foldable mat having a first edge and a second edge;

a first bendable wing connected to the first edge of the foldable mat, the first bendable wing having a first inner side, an opposite first outer side, and a first opening extending through both the first inner side and the first outer side of the first bendable wing;

a second bendable wing connected to the second edge of the foldable mat, the second bendable wing having a second inner side, an opposite second outer side, and a second opening extending through both the second inner side and the second outer side of the second bendable wing; and an arch having a first end and a second end coupled to the foldable mat, the arch bridging the first and second edges of the foldable mat and being positionable in an upright position where the arch is substantially perpendicular to the foldable mat and a recumbent position where the arch is substantially parallel to the foldable mat.

2. The baby activity center of claim 1, wherein the activity center is transformable to a gym configuration where the foldable mat is expanded and the arch is in the upright position, an activity mat configuration where the foldable mat is expanded and the arch is in the recumbent position, and a transport configuration where the foldable mat is folded and the arch is between the folded mat in the recumbent position.

3. The baby activity center of claim 1, wherein the first end of the arch is engaged with the first opening of the first bendable wing and the second end of the arch is engaged with the second opening of the second bendable wing when the arch is in the upright position.

4. The baby activity center of claim 3, wherein the first end of the arch is disengaged from the first opening of the first bendable wing and the second end of the arch is disengaged from the second opening of the second bendable wing when the arch is in the recumbent position.

5. The baby activity center of claim 1, wherein the arch is maintained in the upright position by engagement of the first end of the arch with the first bendable wing and the second end of the arch with the second bendable wing and positioning the first and second ends of the arch on a support surface.

6. The baby activity center of claim 1, wherein the first and second bendable wings are removably attached to the arch while the arch is in the upright position.

7. The baby activity center of claim 1, further comprising a first coupling member and a second coupling member, the first coupling member coupling the first end of the arch to the foldable mat and the second coupling member coupling the second end of the arch to the foldable mat.

8. The baby activity center of claim 7, wherein the foldable mat has an upper surface and a bottom surface, and the first and second coupling members are each secured with at least two reinforcement points to the bottom surface of the foldable mat.

9. The baby activity center of claim 8, wherein one of the at least two reinforcement points of the first coupling member is disposed along the first edge of the foldable mat and one of the at least two reinforcement points of the second coupling member is disposed along the second edge of the foldable mat.

10. The baby activity center of claim 2, wherein the foldable mat has a first end and a second end, the first end including a loop and the second end including a slit for the loop to pass through while the foldable mat is folded in the transport configuration.

11. The baby activity center of claim 1, wherein:

the foldable mat has an upper surface and a bottom surface;

the arch has a first side and an opposite second side; and the arch is positionable in the recumbent position with either the first side facing the upper surface of the foldable mat or the second side facing the upper surface of the foldable mat.

12. The baby activity center of claim 1, wherein the arch is of uniform thickness.

13. The baby activity center of claim 1, wherein an apex portion of the arch is thicker than remaining portions of the arch.

14. The baby activity center of claim 1, further comprising accessories removably attached to the arch.

15. A baby activity center comprising:

a foldable mat;

a pair of bendable wings connected to the foldable mat, each bendable wing having a first side, an opposing second side, and an opening extending through the first side and the second side; and an arch coupled to the foldable mat, the arch positionable in an upright position and a recumbent position;

wherein the arch is engaged with the openings in the pair of bendable wings while the arch is in the upright position and the arch is disengaged from the openings in the pair of bendable wings while the arch is in the recumbent position.

16. The baby activity center of claim 15, wherein the activity center is transformable to a gym configuration where the foldable mat is expanded and the arch is in the upright position, an activity mat configuration where the foldable mat is expanded and the arch is in the recumbent position, and a transport configuration where the foldable mat is folded and the arch is between the folded mat in the recumbent position.

17. The baby activity center of claim 15, wherein the arch is maintained in the upright position by engagement of the arch with the pair of bendable wings and positioning the arch on a support surface.

18. A baby activity center comprising:

a foldable mat;

a pair of bendable wings connected to the foldable mat, each bendable wing having a first side, an opposing second side, and an opening extending through the first side and the second side; and an arch coupled to the foldable mat, the arch positionable in an upright position by engaging with the openings in the pair of bendable wings and further positionable in a recumbent position by disengaging from the openings in the pair of bendable wings;

wherein the activity center transforms to a gym configuration where the foldable mat is expanded and the arch is positioned in the upright position across the foldable mat, and a transport configuration where the foldable mat is folded and the arch is positioned in the recumbent position between the folded mat.

19. The baby activity center of claim 18, further comprising a pair of coupling members that couple the arch to the foldable mat through the openings in the pair of bendable wings.

20. The baby activity center of claim 18, wherein the arch is maintained in the upright position by engagement of the arch with the pair of bendable wings and positioning the arch on a support surface.

* * * * *